United States Patent [19]

Kubach et al.

[11] Patent Number: 4,536,731

[45] Date of Patent: Aug. 20, 1985

[54] ELECTRIC CONTROL MOTOR

[75] Inventors: Hans Kubach, Korntal-Münchingen; Ulrich Kemmner, Stuttgart; Gerold Grimm, Leonberg, all of Fed. Rep. of Germany

[73] Assignee: Robert Bosch GmbH, Stuttgart, Fed. Rep. of Germany

[21] Appl. No.: 423,920

[22] Filed: Sep. 27, 1982

[30] Foreign Application Priority Data

Jun. 24, 1982 [DE] Fed. Rep. of Germany ..... 3223557

[51] Int. Cl.[3] ..... H01F 7/08

[52] U.S. Cl. ..... 335/272; 310/36

[58] Field of Search ..... 310/36–39, 310/43; 335/272, 222

[56] References Cited

U.S. PATENT DOCUMENTS

| | | | |
|---|---|---|---|
| 1,764,658 | 6/1930 | Stoecklin | 310/36 UX |
| 2,767,357 | 10/1956 | Naybor | 310/36 UX |
| 3,229,171 | 1/1966 | Daugherty | 335/272 |
| 4,345,228 | 8/1982 | Idogaki et al. | 310/36 X |

*Primary Examiner*—Donovan F. Duggan

*Attorney, Agent, or Firm*—Edwin E. Greigg

[57] ABSTRACT

An electric control motor and a method of making the same are proposed for the driving of a control element. The electric control motor comprises a housing made from a ferromagnetic material, a housing enclosure and a cap, a shaft rotatably disposed therein on which an armature is disposed for association with arcuate poles provided in the housing. An electromagnetic coil comprising coil portions is mounted axially with respect to the armature in coil retainers encapsulating the armature and shaft as a unit for ease of assembly in the housing.

2 Claims, 2 Drawing Figures

ELECTRIC CONTROL MOTOR

BACKGROUND OF THE INVENTION

The present invention is directed to improvements in electric control motors. Electric control motors are already well known in the art, however, they are not cost effective to manufacture and typically offer great bulk.

OBJECT AND SUMMARY OF THE INVENTION

It is a principal object of the invention to provide an electric control motor which has the advantages of being very simple to produce, cost effective to manufacture and of compact size.

It is another object of the invention to provide a construction in which it is advantageous to pre-assemble the armature and electro-magnetic coil outside of the housing and then to install them as an assembly in the housing of the control motor.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the present invention is shown in a simplified manner in the drawing and is explained in greater detail in the following description.

DESCRIPTION OF THE PREFERRED EMBODIMENT

Figure 1:
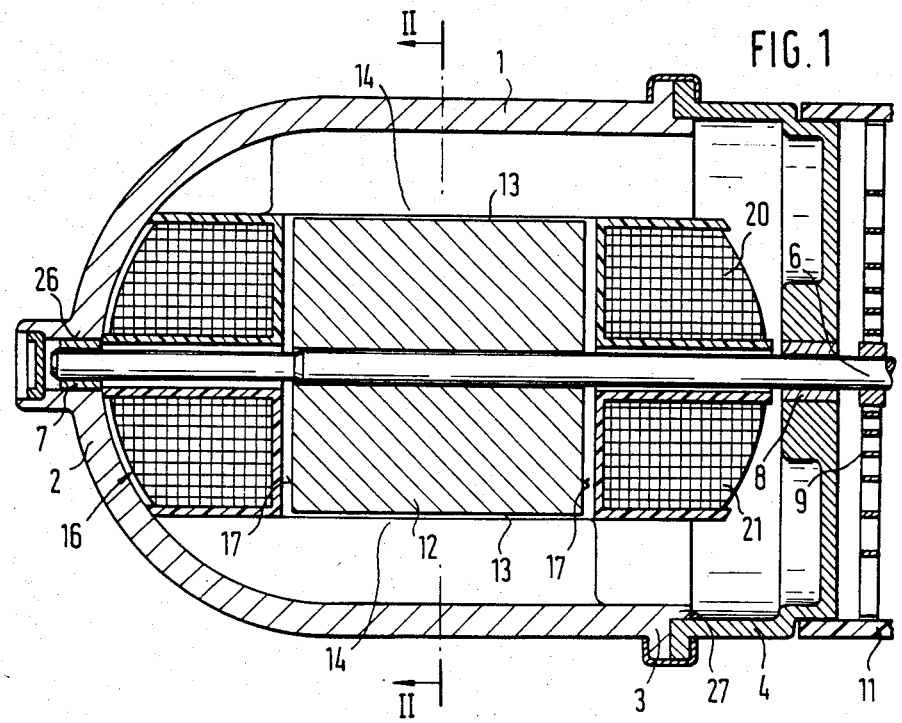
FIG. 1 is a sectional view through an electric control motor in accordance with the present invention.
Figure 2:
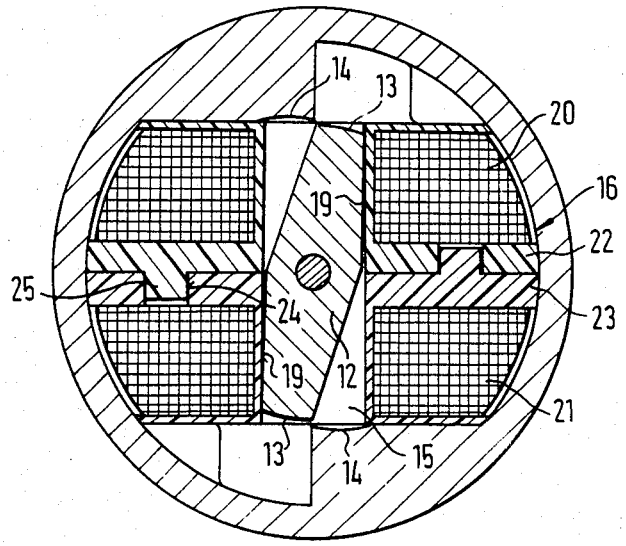
FIG. 2 is a cross-sectional view along the lines II—II of FIG. 1.

The electric control motor shown in FIG. 1 has a cup-shaped housing 1 comprised of ferro-magnetic material, having a housing enclosure or bottom 2 terminating in an open end 3 at one extremity thereof. A cap 4 can be placed upon the open end 3 and connected therewith. A shaft 6 is disposed axially within the housing 1 supported in the housing enclosure 2 on one end and in the cap 4 on the other end, as shown. In the exemplary embodiment of the electric control motor, a friction bearing 7 is disposed in the housing enclosure 2 and a friction bearing 8 is disposed in the cap 4, in which the shaft 6 is seated rotatably. The rotational movement of the shaft 6 takes place against the force of a coil spring 9 disposed securely on the shaft 6 adjacent cap 4, whose circumferential extremity is fastened in a guide 11 firmly attached to the housing. An armature 12 is provided on the shaft 6, which has, as shown in FIG. 2, two circular armature poles 13. In opposed relation to the armature poles 13, two arcuate poles 14 are formed in the housing 1. As shown in FIG. 2, the arcuate poles 14 may not be disposed in co-planar relation and further they may be asymmetrically disposed with respect to the plane of the armature 12. The armature 12 is disposed in a chamber 15 which is delimited axially by an electromagnetic coil 16. The electromagnetic coil 16 is disposed so as to lay axially parallel to the shaft 6 with front and rear portions confronting the respective end faces 17 disposed adjacent to the friction bearings 7, 8. In order to perform a sufficient rotational movement in the chamber 15, the armature 12 is equipped with chamfered portions 19. Advantageously, the electromagnetic coil 16 comprises at least two coil portions 20, 21, connected with a continuous winding wire and the coil retainers 22, 23 can be interlocked together by means of complemental receptacles 24 on the one side and tabs 25 on the other. These retainers make it feasible to assemble the electromagnetic coil 16 around the armature 12 mounted on the shaft 6 prior to insertion into the housing 1 and thereby to mount the assembly of electromagnetic coil 16 together with the shaft 6 and the armature 12 into the housing 1 as a unit. Upon mounting only the lid 4 needs to be attached to the housing 1. When the electromagnetic coil 16 is excited, a circular current flows around the armature 12 pushing a magnetic flux through the armature, by which the armature 12, depending upon the strength of the electric current, is attracted by the arcuate poles 14 against a force exerted by the coil spring 9 which depends upon the degree by which the armature rotates. The rotational movement of the shaft 6 can be used, for instance, to activate a rotary slide which, in a known manner, can open or close to a varying degree a fuel bypass associated with a throttle valve in the inlet pipe of an internal combustion engine, for instance, in order to regulate the idle of an internal combustion engine. The housing 1 also serves at the same time as an electromagnetic ground and shield. Constructing the electric control motor in accordance with the present invention makes it possible to form in one operation during the construction of the housing 1, the opening 26 in the housing enclosure 2 for receiving the friction bearing 7, the arcuate poles 14 as well as the flange 27 for receiving the cap 4.

This construction assures a very small eccentricity of the seating of the armature 12 with respect to the arcuate poles 14, resulting in a very small radial force on the armature 12 created by that eccentricity, thereby keeping the friction in the bearings small. Electric motors constructed in accordance with the present invention provide for cost-effective fabrication and result in a very compact assembled unit.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electric control motor comprising a housing of ferromagnetic material, said housing being provided with an electromagnetic coil and an armature, said armature being associated with poles provided in said housing and further being rotatable in opposition to a return force, said housing further comprising a cup-shaped housing bottom, having an open end and a cap for sealing said open end, said electromagnetic coils include at least two interconnected, oppositely disposed coil portions which are mounted in coil retainers which can be interlocked together within said housing so as to confront extremities of said armature and axially disposed within said housing with respect to said armature, said armature being disposed on a shaft axially of said housing and further that said shaft is supported in said cap and said housing bottom, said chamber being defined by said poles, an inner wall of said housing and said electromagnetic coil.

2. An electric control motor as in claim 1, further characterized in that said armature and shaft are encapsulated by said coil retainers to form a unit, whereby assembly of said electric control motor is simplified.

* * * * *